US010134518B2

(12) United States Patent
Zybura et al.

(10) Patent No.: US 10,134,518 B2
(45) Date of Patent: Nov. 20, 2018

(54) RADIO FREQUENCY TRANSMISSION LINE TRANSFORMER

(75) Inventors: Michael F. Zybura, Scotts Valley, CA (US); Toshiaki Moriuchi, San Jose, CA (US)

(73) Assignee: Qorvo US, Inc., Greensboro, NC (US)

( * ) Notice: Subject to any disclaimer, the term of this patent is extended or adjusted under 35 U.S.C. 154(b) by 145 days.

(21) Appl. No.: 13/524,364

(22) Filed: Jun. 15, 2012

(65) Prior Publication Data

US 2013/0335182 A1 Dec. 19, 2013

(51) Int. Cl.
*H01F 5/00* (2006.01)
*H01F 27/28* (2006.01)
*H01F 19/04* (2006.01)

(52) U.S. Cl.
CPC ..... *H01F 19/04* (2013.01)

(58) Field of Classification Search
CPC ..... H01F 27/28; H01F 27/2804; H01F 27/29; H01F 19/02; H01F 19/04; H01F 19/06; H01F 5/003
USPC ..... 336/220–223, 232, 182, 200
See application file for complete search history.

(56) References Cited

U.S. PATENT DOCUMENTS 5,949,321 A * 9/1999 Grandmont et al. ..... 336/232
6,198,374 B1 * 3/2001 Abel ..... 336/200
6,608,364 B2 * 8/2003 Carpentier ..... H01L 27/08 257/528
7,176,776 B1 * 2/2007 Tantwai et al. ..... 336/200
7,626,472 B2 * 12/2009 Davies-Venn et al. ..... 333/26
7,978,041 B2 * 7/2011 Bertilsson ..... H01F 27/2804 336/200
2003/0085788 A1 * 5/2003 Yue ..... 336/200
2007/0120639 A1 * 5/2007 Strzalkowski et al. ..... 336/232
2010/0060402 A1 * 3/2010 Chen ..... H03H 7/422 336/200
2010/0188171 A1 * 7/2010 Mohajer-Iravani et al. ..... 333/175
2011/0109417 A1 * 5/2011 Bertram et al. ..... 336/200

* cited by examiner

*Primary Examiner* — Mangtin Lian
(74) *Attorney, Agent, or Firm* — Withrow & Terranova, P.L.L.C.

(57) ABSTRACT

Radio frequency (RF) transmission line transformers are disclosed. Unlike conventional transformers that employ magnetic cores that transmit energy from input to output through magnetic flux linkages, the embodiments of the RF transmission line transformer disclosed herein transfer energy by configuring transformer coils as balanced transmission lines. More specifically, the RF transmission line transformers have a primary transformer coil that forms at least one primary winding and a secondary transformer coil that forms at least a pair of secondary windings. The primary winding of the primary transformer coil is disposed between the pair of secondary windings so that the primary winding forms a different balanced transmission line with each one of the pair of secondary windings. This results in greater bandwidth and higher transformer power efficiency (TPE) at RF frequencies. Furthermore, the arrangement allows for reduced parasitic inductances and capacitances and thus is particularly advantageous when utilized in laminated substrates.

16 Claims, 8 Drawing Sheets

RADIO FREQUENCY TRANSMISSION LINE TRANSFORMER

FIELD OF THE DISCLOSURE

The disclosure relates generally to radio frequency (RF) transmission line transformers.

BACKGROUND

FIG. 1A illustrates a circuit diagram of a conventional transformer 10 from related art. The conventional transformer 10 includes a primary transformer coil 12 and a secondary transformer coil 14. The primary transformer coil 12 and the secondary transformer coil 14 are magnetically coupled by a magnetic core (not explicitly illustrated). This arrangement is typically used in radio frequency (RF) applications where the conventional transformer 10 is provided within or on a laminated substrate along with other RF devices. More particularly, the conventional transformer 10 is operable to convert a higher voltage/lower current (HVLC) signal 16 to a lower voltage/higher current (LVHC) signal 18, and vice versa. The conventional transformer 10 also provides isolation between RF devices connected to the primary transformer coil 12 and the secondary transformer coil 14. Furthermore, an impedance transformation provided by the primary transformer coil 12 and the secondary transformer coil 14 can be used to provide impedance matching between the RF devices.

In the conventional transformer 10, the primary transformer coil 12 is the coil that receives and/or outputs the HVLC signal 16 and the secondary transformer coil 14 is the coil that receives and/or outputs the LVHC signal 18. To do this, the primary transformer coil 12 forms one or more primary windings and the secondary transformer coil 14 forms secondary windings. The ratio (i.e., the turns ratio) between the number of primary windings and secondary windings is represented in FIG. 1A as 1:n. Due to the magnetic coupling provided by the magnetic core of the conventional transformer 10, a current of the HVLC signal 16 induces a current of the LVHC signal 18 while a current of the HVLC signal 16 induces a current of the LVHC signal 18. Ideally, the current and voltage transformations between the HVLC signal 16 and the LVHC signal 18 can be expressed as:

$$n = \frac{V_2}{V_1} = \frac{I_1}{I_2}$$

However, non-ideal transformer behavior, particularly when the HVLC signal 16 and the LVHC signal 18 are operating in RF bands, result in transformer losses. As such, the above expression is modified due to the transformer losses resulting in the primary transformer coil 12, the secondary transformer coil 14, and the magnetic core.

FIG. 1B illustrates a transformer model 20 at RF frequencies for the conventional transformer 10 shown in FIG. 1A. The conventional transformer 10 is coupled to a source 22 and a load 24. The source 22 is modeled by a resistor $R_s$ and a capacitor $C_s$ while the load 24 is modeled by a resistor $R_L$ and a capacitor $C_L$. The primary transformer coil 12 has a self-inductance of $L_1$ (See FIG. 1A) and the secondary transformer coil 14 (See FIG. 1A) has a self-inductance of $L_2$. To model the non ideal-behavior of the conventional transformer 10 in the transformer model 20, various components are coupled to an ideal transformer 26. For instance, the primary transformer coil 12 and the secondary transformer coil 14 are lossy. This is modeled by the resistor, $R_1$ and the resistor $R_2$. Furthermore, due to magnetic leakage, the primary transformer coil 12 is modeled by inductor $L_P$ and inductor, $L_{PLEAK}$, while the secondary transformer coil 14 is modeled by the inductor $L_{SLEAK}$. The inductor $L_P$ models the inductance that transfers energy to the secondary transformer coil 14. The inductance of the inductor $L_P$ is equal the magnetic coupling coefficient, k, multiplied by the self-inductance $L_1$ (see FIG. 1A), of the primary transformer coil 12. The inductor $L_{PLEAK}$ models the parasitic magnetic leak in the primary transformer coil 14 and has an inductance that is equal to $(1-k)*L_1$. The inductor $L_{SLEAK}$ models the parasitic magnetic leak in the secondary transformer coil 16 and has an inductance equal to $1-k*L_2$. The capacitance, $C_{PAR}$, models the parasitic capacitance resulting between the primary transformer coil 12 and the secondary transformer coil 14 resulting from electric field leaks in the magnetic core. Generally, the parasitic capacitance, $C_{PAR}$, increases as the frequency increases.

There are various metrics that may be utilized to express the performance of the conventional transformer 10. One of these metrics is the transformer power efficiency (TPE) of the conventional transformer 10. In the RF which can be expressed as:

$$\eta = \frac{P_{Load}}{P_{Total}}$$

where, $P_{Load}$=Power delivered to the load 24

$P_{Total}$=Total available power received from source 22

In the RF frequency range, it can be shown that the maximum efficiency of the conventional transformer 10 is maximized by satisfying the equations:

$$\eta_{max} = \frac{1}{\frac{2}{Q_1 Q_2 k^2} + \sqrt{1 + 2\left[1 + \frac{1}{Q_1 Q_2 k^2}\right] * \frac{1}{Q_1 Q_2 k^2}}}$$

where, $$Q_1 = \frac{\omega L_1}{R_1} = \text{Quality Factor of the primary transformer coil 12}$$

$$Q_2 = \frac{\omega L_2}{R_2} = \text{Quality Factor of the secondary transformer coil 14}$$

$$\omega L_1 = \frac{R_{Load}}{\eta^2 \sqrt{\frac{1}{Q_2^2} + \frac{Q_1}{Q_2 k^2}}}$$

For example, the magnetic coupling coefficient k can be improved by providing thicker windings. Unfortunately, this decreases the required matching of the self-inductances, $L_1$, $L_2$ at the primary transformer coil 12 and the secondary transformer coil 14 set by the self-inductances $L_1$, $L_2$. On the other hand, increasing the self-inductances, $L_1$, $L_2$, to increase matching can decrease the quality factors $Q_1$, $Q_2$. Accordingly, matching, the quality factors, and the magnetic coupling coefficient must be balanced to maximize TPE.

While the conventional transformer 10 can provide suitable impedance transformation and low losses at lower frequencies, the conventional transformer 10 is significantly undermined at higher RF frequencies by parasitics in the magnetic core arrangement. On the other hand, transmission line transformer structures are generally not employed in RF applications due to their high cost, low quality factors, and poor magnetic coupling efficients in laminated substrates, such as printed circuit boards (PCBs).

Therefore, what is needed is a transformer structure that can provide better power efficiency at RF frequencies, particularly when the transformer is being employed in a laminated substrate.

SUMMARY

Embodiments of radio frequency (RF) transmission line transformers are disclosed. In one embodiment, an RF transmission line transformer includes a primary transformer coil that forms a first primary winding and a secondary transformer coil that forms a first secondary winding and a second secondary winding. To reduce the parasitics, the first primary winding of the primary transformer coil is disposed between the first secondary winding and the second secondary winding of the secondary transformer coil such that the first primary winding and the first secondary winding provide a first balanced transmission line, and the first primary winding and the second secondary winding provide a second balanced transmission line. By providing the first primary winding between the first secondary winding and the second secondary winding, a coupling coefficient between the primary transformer coil and the second transformer coil is increased. Furthermore, a quality factor of the primary transformer coil and a quality factor of the secondary transformer coil are not detrimentally affected by the increase of the coupling coefficient and additional L1, L2. In this manner, the efficiency of the RF transmission line transformer is increased.

Those skilled in the art will appreciate the scope of the present disclosure and, realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

Figure 1A:
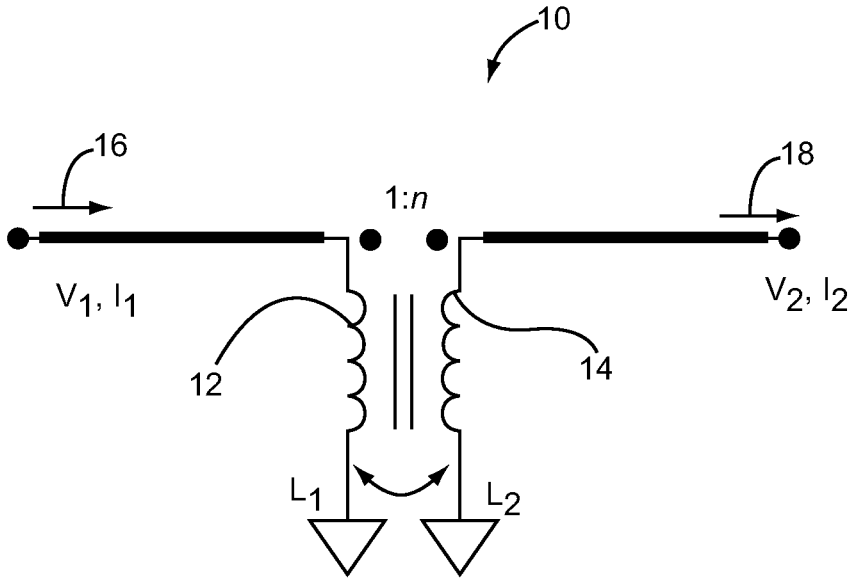
FIG. 1A (RELATED ART)
FIG. 1A illustrates a circuit diagram of a conventional transformer from related art.
Figure 1B:
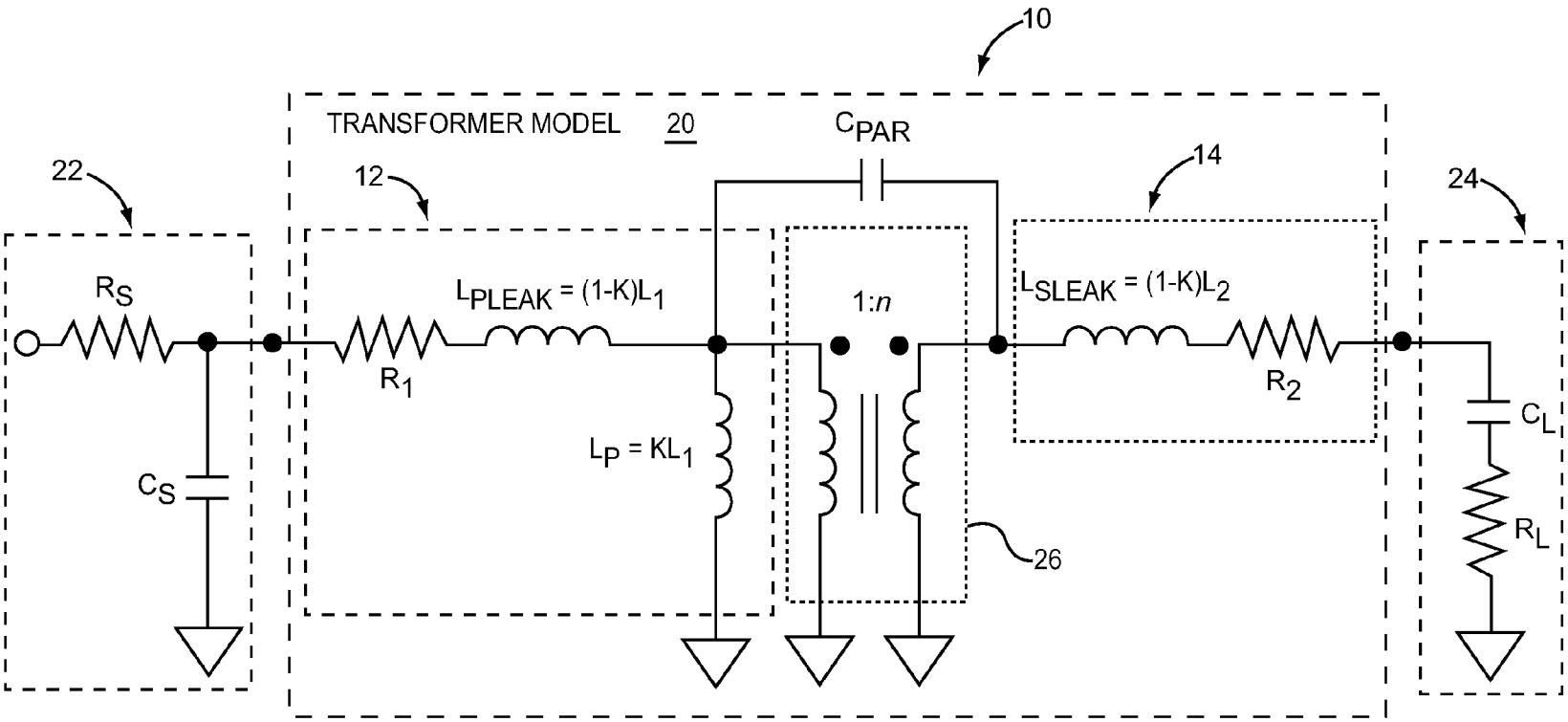
FIG. 1B (RELATED ART)
FIG. 1B illustrates a circuit diagram that shows a transformer model of the conventional transformer in FIG. 1A.
Figure 2:
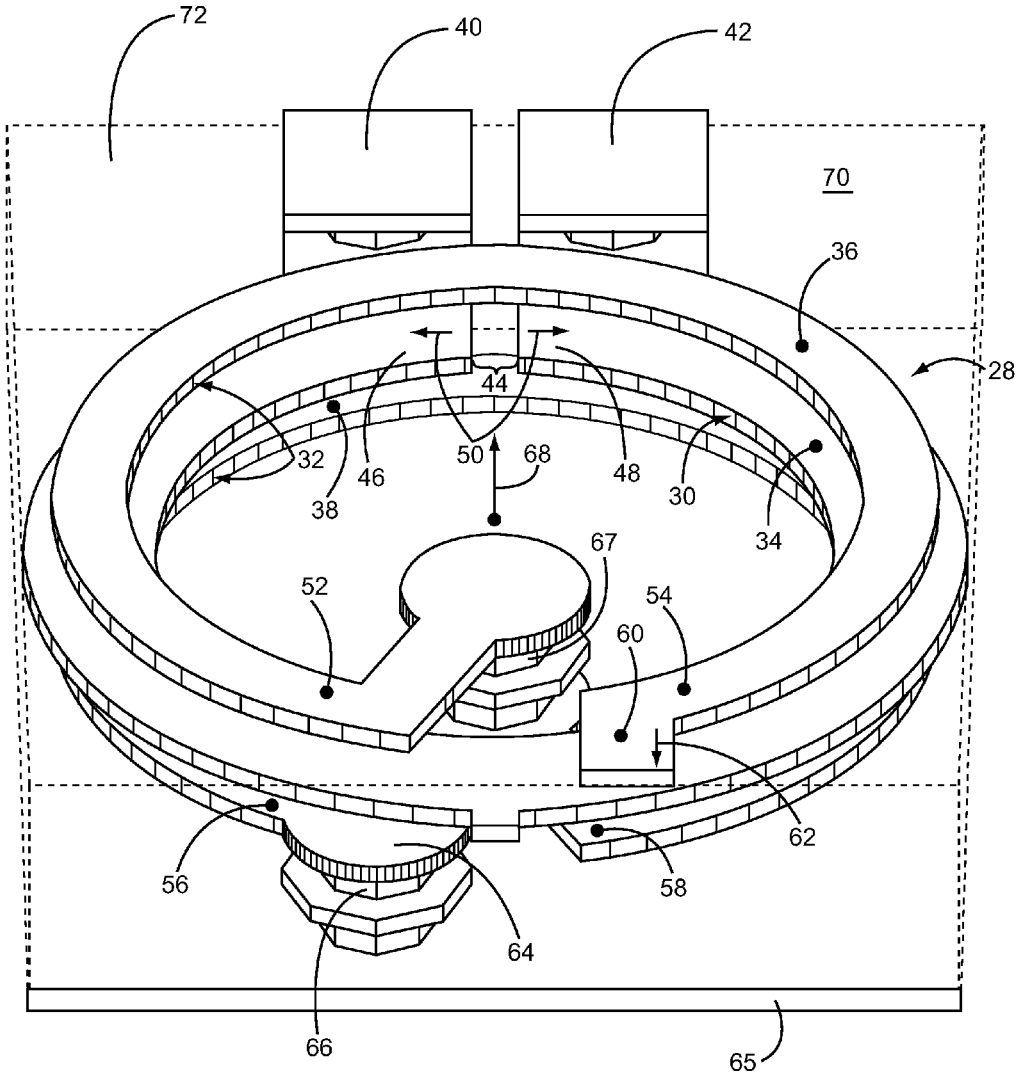

FIG. 2 illustrates one embodiment of a radio frequency (RF) transmission line transformer in accordance with this disclosure. The RF transmission line transformer has a primary winding formed by a primary transformer coil disposed between a pair of secondary windings formed by a secondary transformer coil so that two balanced transmission lines are provided between the primary winding and one of the secondary windings and the primary winding and another one of the secondary windings, one balanced transmission line between the primary winding and the one of the secondary winding and the other balanced transmission line between the primary winding and the other secondary winding.

Figure 3:
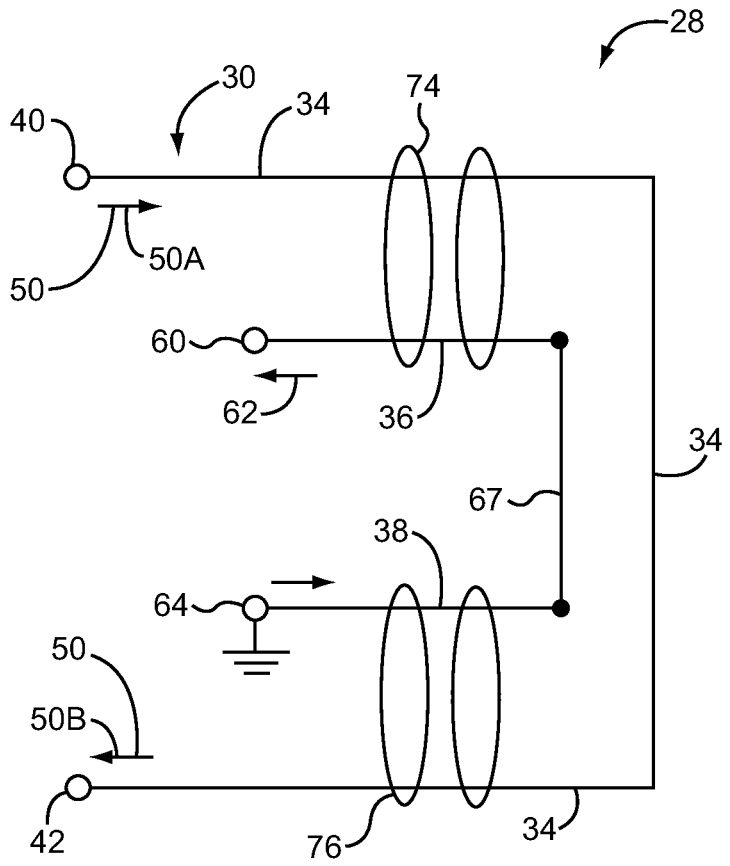

FIG. 3 illustrates a circuit diagram of the RF transmission line transformer shown in FIG. 2.

Figure 4:
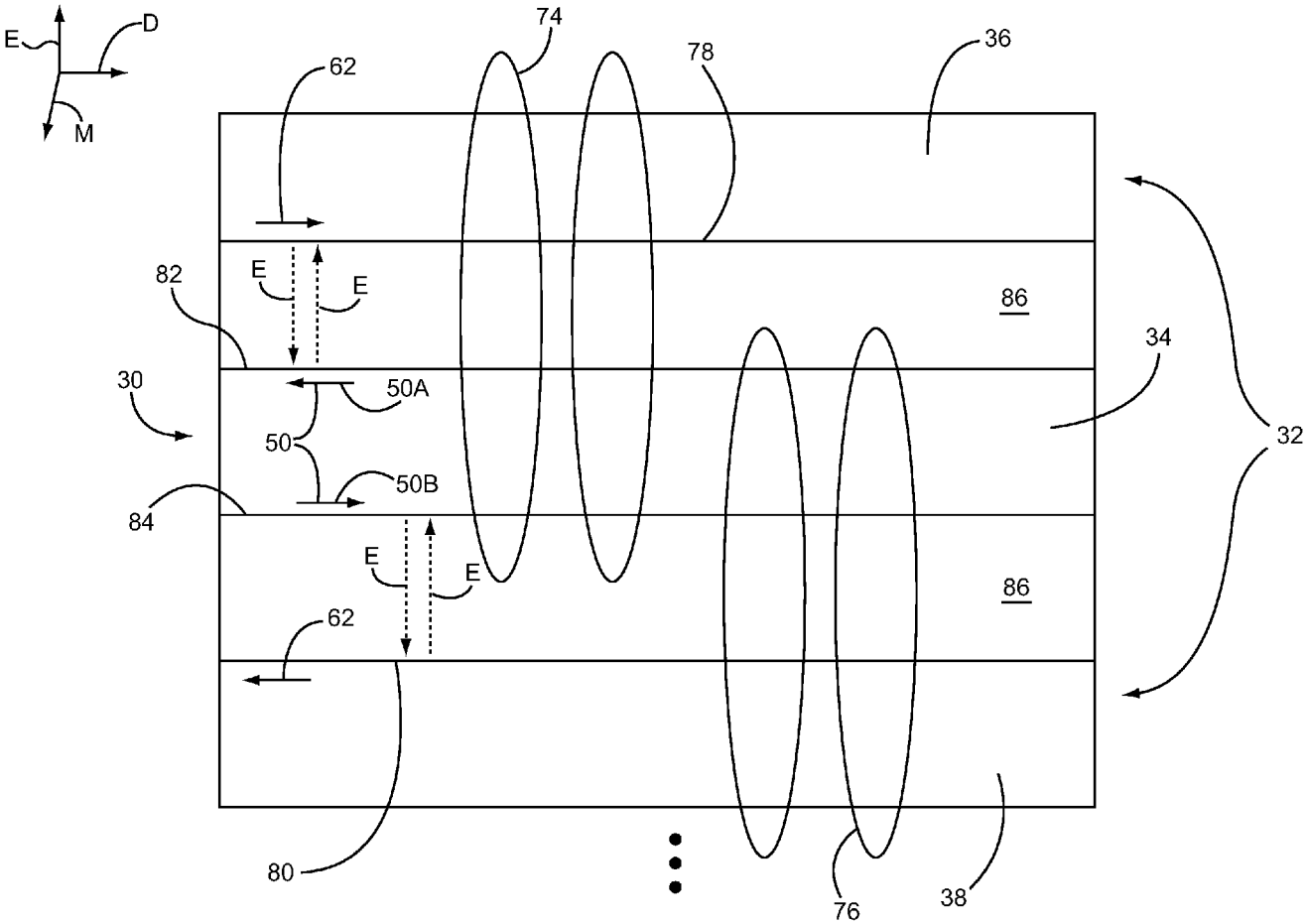

FIG. 4 illustrate a cross-section of the primary winding and the secondary windings shown in FIG. 2 in order to demonstrate signal propagation through the balanced transmission lines.

Figure 5:
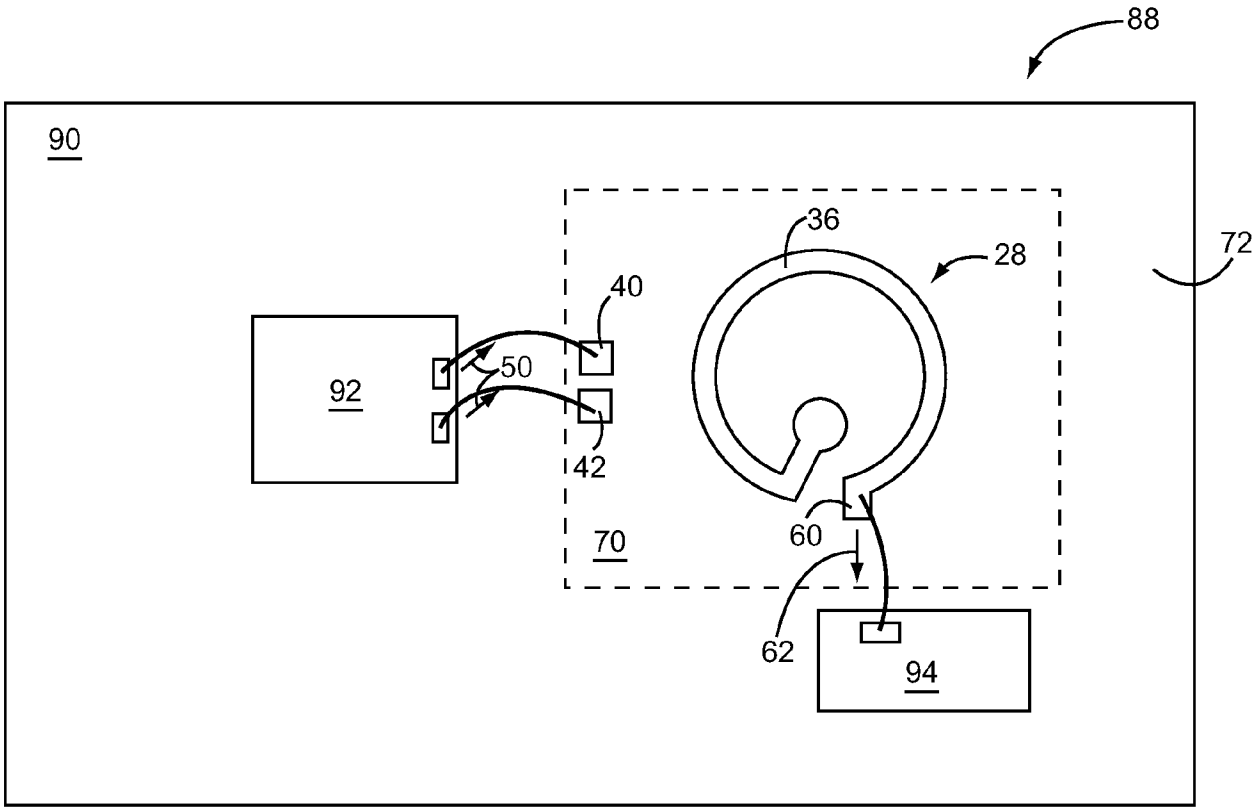

FIG. 5 illustrates one embodiment of a laminated substrate that includes the RF transmission line transformer integrated into a laminated substrate body of the laminated substrate.

Figure 6:
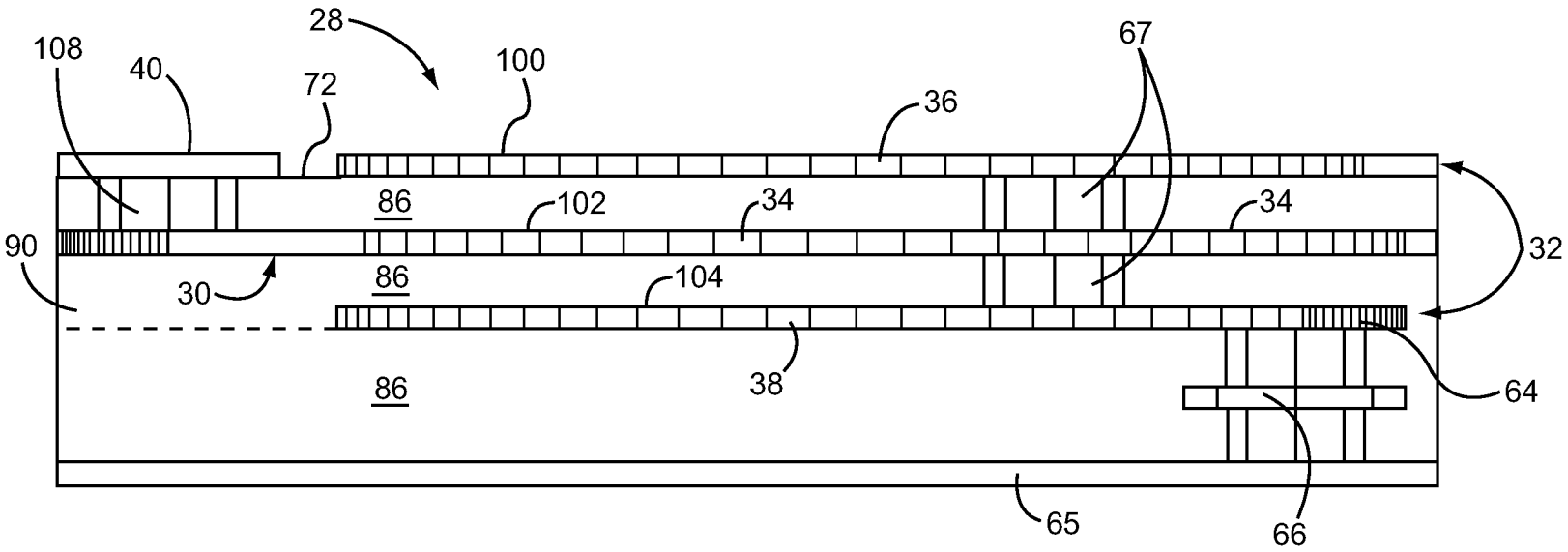

FIG. 6 illustrates a cross-section of the RF transmission line transformer integrated within the laminated substrate body of the laminated substrate of FIG. 5.

Figure 7:
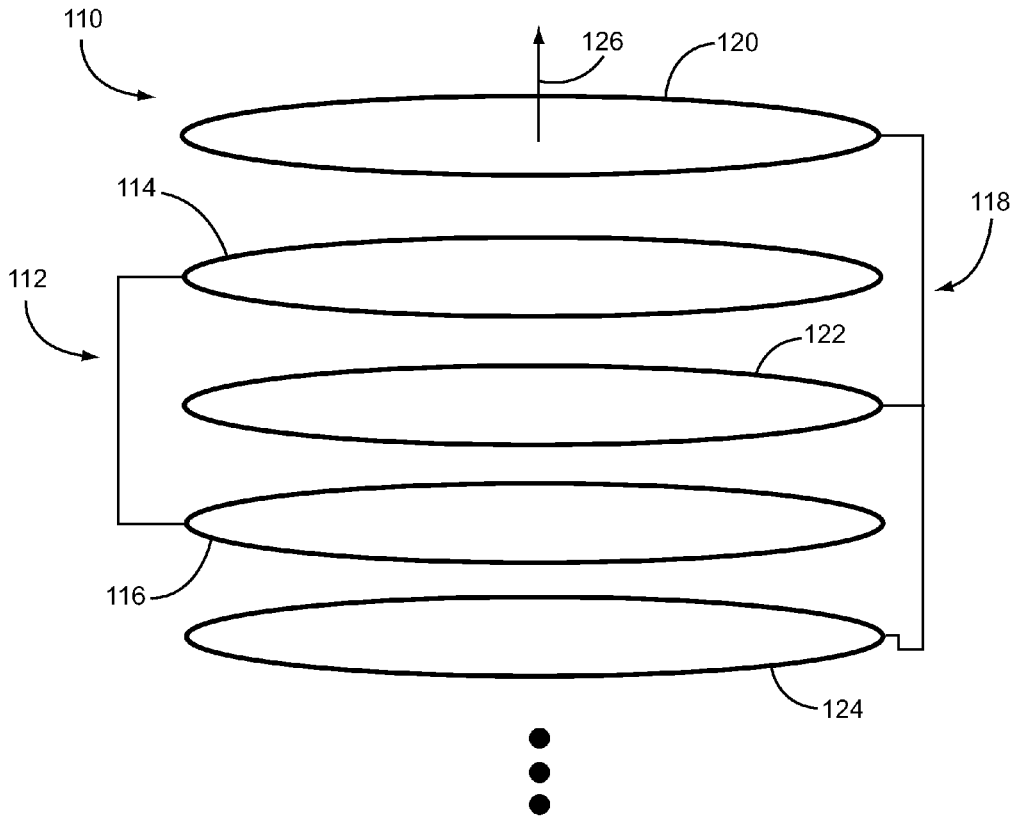

FIG. 7 illustrates another embodiment of the RF transmission line transformer having a primary transformer coil and a secondary transformer coil with multiple primary windings of the primary transformer coil disposed between secondary windings of the secondary transformer coil.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The disclosure relates generally to radio frequency (RF) transmission line transformers. Unlike conventional transformers that employ magnetic cores that transmit energy from input to output through magnetic flux linkages, the embodiments of the RF transmission line transformer disclosed herein transfer energy by configuring transformer coils as balanced transmission lines. More specifically, the RF transmission line transformers have a primary transformer coil that forms at least one primary winding and a secondary transformer coil that forms at least a pair of secondary windings. The primary winding of the primary transformer coil is disposed between the pair of secondary windings so that the primary winding forms a different balanced transmission line with each one of the pair of secondary windings. This results in greater bandwidth and higher transformer power efficiency (TPE) at RF frequencies. Furthermore, the arrangement allows for reduced parasitic inductances and capacitances and thus is particularly advantageous when utilized in laminated substrates.

FIG. 2 illustrates one embodiment of a RF transmission line transformer 28 in accordance with this disclosure. The RF transmission line transformer 28 includes a primary transformer coil 30 and a secondary transformer coil 32. The primary transformer coil 30 forms a first primary winding 34. The secondary transformer coil 32 forms a first secondary winding 36 and a second secondary winding 38. The primary transformer coil 30 is the transformer coil configured for a high voltage/low current RF signal. To input or output the high voltage/low current RF signal, the primary transformer coil 30 also includes a first terminal 40 and a second terminal 42. At a gap 44 of the first primary winding 34, the first primary winding 34 provides a winding end 46 and an antipodal winding end 48. The first terminal 40 directly connects to the winding end 46 of the first primary winding 34. Analogously, the second terminal 42 directly connects to the winding end 48 of the first primary winding 34. In this manner, the high voltage/low current RF signal transmitted through the first primary winding 34 is a RF differential signal 50. This RF differential signal 50 can be input or output from the first terminal 40 and the second terminal 42 of the primary transformer coil 30 to/from another RF device (not shown).

With regard to the secondary transformer coil 32, the first secondary winding 36 has a winding end 52 and an antipodal winding end 54, while the second secondary winding 38 of the secondary transformer coil 32 has a winding end 56 and an antipodal winding end 58. Additionally, the secondary transformer coil 32 includes a third terminal 60 and a grounding element 64. The grounding element 64 is arranged to be coupled to ground. In this embodiment, the grounding element 64 is coupled to ground plate 65. The ground via 66 is part of the grounding element 64 and provides a lead to the ground plate 65. The third terminal 60 may be coupled to another RF device (not shown) and may directly connect to the winding end 54 of the first secondary winding 36. So that the secondary transformer coil 32 is provided contiguously, the winding end 52 of the first secondary winding 36 directly connects to the winding end 58 of second secondary winding 38. To directly connect the winding end 52 and the winding end 58, a conductive via 67 connects the first secondary winding 36 and the second secondary winding 38 of the secondary transformer coil 32. Finally, the grounding element 64 is connected to the winding end 56 of the second secondary winding 38. In this manner, the low voltage/high current RF signal transmitted by the secondary transformer coil 32 is a RF single ended signal 62. The RF single ended signal 62 can be input or output from the third terminal 60 which may be coupled to another RF device.

While the primary transformer coil 30 is arranged for the RF differential signal 50, in alternative embodiments the primary transformer coil 30 may be arranged to transmit a single ended signal. Additionally, in alternative embodiments, the secondary transformer coil 32 may be configured to transmit a differential signal. However, the configuration of the RF transmission line transformer 28 is advantageous in many RF applications. For example, RF power amplifiers often output differential signals such as the RF differential signal 50. Similarly, antenna switches often receive single ended signals such as the RF single ended signal 62. As explained in further detail below, the RF transmission line transformer 28 may be utilized between the RF amplifier and the antenna switch to provide impedance matching and isolate the devices.

Unlike conventional transformers that transfer energy between transformer coils through the magnetic flux linkage provided by a magnetic core, the RF transmission line transformer 28 transfers energy from the primary transformer coil 30 to the secondary transformer coil 32 and/or from the secondary transformer coil 32 to the primary transformer coil 30 by arranging the windings 34, 36, and 38 as balanced transmission lines. To provide the balanced transmission lines, balanced transmission lines have two conductors which are arranged to substantially reduce common mode currents between the conductors so that the current on the conductors are approximately equal in magnitude and approximately opposite in phase while the voltages across the length of the two conductors are approximately equal in both magnitude and phase. The first primary winding 34 of the primary transformer coil 30 is disposed between the first secondary winding 36 and the second secondary winding 38 of the secondary transformer coil 32. The disposition of the first primary winding 34 between the first secondary winding 36 and the second secondary winding 38 is such that the first primary winding 34 and the first secondary winding 36 provide a first balanced transmission line while the first primary winding 34 and the second secondary winding 38 provide a second balanced transmission line. In this embodiment, the first primary winding 34, the first secondary winding 36, and the second secondary winding 38 are substantially coaxially aligned around a common axis 68. The first primary winding 34 of the primary transformer coil 30, the first secondary winding 36, and the second secondary winding 38 of the secondary transformer coil 32 are conic planar curve structures that are aligned so that an inner surface of the first secondary winding 36 and an inner surface of the second secondary winding 38 each face one of the surfaces of the first primary winding 34. Accordingly, the first primary winding 34 of the primary transformer coil 30 and the first secondary winding 36 of the secondary transformer coil 32 provide a first balanced transmission line while the first primary winding 34 of the primary transformer coil 30 and the second secondary winding 38 of the secondary transformer coil 32 provide a second balanced transmission line.

To maximize the cancellation of common mode currents, the first primary winding 34, the first secondary winding 36, and the second secondary winding 38 have substantially the same symmetry around the common axis 68. In the embodiment shown in FIG. 2, the first primary winding 34 of the primary transformer coil 30, the first secondary winding 36 of the secondary transformer coil 32, and the second secondary winding 38 of the secondary transformer coil 32 are formed as traces having a horizontal trace width anywhere from 150 um to 200 um and a vertical trace thickness of about 20 um. With regard to the conic plane curve structures of the first primary winding 34, the first secondary winding 36, and the second secondary winding 38, each are circular ring structures having a radius of approximately 700 um. Alternative embodiments however may be in other shapes such as ellipsoids where the minor axis and major axis of the ellipsoids are aligned and the first primary winding 34, the first secondary winding 36, and the second secondary winding 38 have substantially a same symmetry around the common axis 68.

The RF transmission line transformer 28 shown in FIG. 2 includes a laminate core 70 made from a laminate material, such as FR-1, FR-2, FR-3, FR-4, FR-5, FR-6, CEM-1, CEM-2, CEM-3, CEM-4, CEM-5, CX-5, CX-10, CX-20, CX-30, CX-40, CX-50, CX-60, CX-70, CX-80, CX-90, CX-100, and/or the like. As explained in further detail below, the laminate core 70 may be part of a laminated substrate body of a laminated substrate. For example, the laminate core 70 may be part of the laminated substrate body of a printed circuit board (PCB). The primary transformer coil 30 and the secondary transformer coil 32 may be formed as part of a metallic structure within the laminate core 70 of the PCB. Other RF devices, such as an RF power amplifier and/or an antenna switch, may be provided on the PCB and coupled to the first terminal 40 and the second terminal 42, and/or to the third terminal 60.

In this embodiment, the first secondary winding 36 and third terminal 60 of the secondary transformer coil 32 are provided on a surface 72 of the laminate core 70, along with the first terminal 40 and the second terminal 42 of the primary transformer coil 30. The first primary winding 34 of the primary transformer coil 30 and the second secondary winding 38 of the secondary transformer coil 32 are within the laminate core 70 where the grounding element 64 connects the winding end 56 of the second secondary winding 38 to the ground plate 65. The conductive via 67 connects the winding end 52 of the first secondary winding 36 through the laminate core 70 to the second secondary winding 38 in the secondary transformer coil 32. Alternative embodiments of the RF transmission line transformer 28 may be configured to be a coreless RF transmission line transformer. For example, the RF transmission line transformer 28 may be provided entirely over the surface 72 of the laminate material. In this alternative embodiment, the first primary winding 34 is separated from the first secondary winding 36 and the second secondary winding 38 by air or free space. In this case, the ground via 66 may extend through the entire laminate material to couple to the ground plate 65.

FIG. 3 illustrates a circuit diagram of the RF transmission line transformer 28 shown in FIG. 2. As discussed above, the primary transformer coil 30 has the first terminal 40 and the second terminal 42 so as to input or output the RF differential signal 50. The secondary transformer coil 32 has the third terminal 60 that inputs or outputs the RF single ended signal 62 while the grounding element 64 is coupled to ground. The RF transmission line transformer 28 has a turns ratio of 1:2. Thus, the RF differential signal 50 has twice the voltage and half the current of the RF single ended signal 62. As discussed above, the first primary winding 34 of the primary transformer coil 30 is disposed between the first secondary winding 36 and the second secondary winding 38 of the secondary transformer coil 32 such that the first primary winding 34 and the first secondary winding 36 provide a first balanced transmission line 74 and the first primary winding 34 and the second secondary winding 38 provide a second balanced transmission line 76. In the embodiment shown in FIG. 3, the RF differential signal 50 has a positive polarity 50A and a negative polarity 50B.

With regard to the first balanced transmission line 74, the first primary winding 34 of the primary transformer coil 30 serves as one conductor of the first balanced transmission line 74 while the first secondary winding 36 of the secondary transformer coil 32 serves as a second conductor of the first balanced transmission line 74. As such, the positive polarity 50A of the RF differential signal 50 and the RF single ended signal 62 are differential to one another in the first balanced transmission line 74.

With regard to the second balanced transmission line 76, the first primary winding 34 of the primary transformer coil 30 also forms one conductor of the second balanced transmission line 76 while the second secondary winding 38 of the secondary transformer coil 32 provides the second conductor of the second balanced transmission line 76. As such, the negative polarity 50B of the RF differential signal 50 and the RF single ended signal 62 are differential to one another in the second balanced transmission line 76.

FIG. 4 illustrates a cross section of the first primary winding 34 and the secondary windings 36, 40 so as to demonstrate exemplary signal propagation through the first balanced transmission line 74 and the second balanced transmission line 76. At RF frequencies, currents are concentrated at the surfaces of the conductors. More specifically, in the first balanced transmission line 74, the RF single ended signal 62 flows along an inner surface 78 of the first secondary winding 36 formed by the secondary transformer coil 32. Similarly, the RF single ended signal 62 propagates along the inner surface 80 of the second secondary winding 38 formed by the secondary transformer coil 32. As noted above, the first balanced transmission line 74 and the second balanced transmission line 76 substantially reduce common mode currents. As a result, the positive side 50A of the RF differential signal 50 propagates along an inner surface 82 of the first primary winding 34 formed by the primary transformer coil 30. The negative side 50B of the RF differential signal 50 propagates along an antipodal inner surface 84 of the first primary winding 34 formed by the primary transformer coil 30.

As shown in FIG. 4, the currents of the RF differential signal 50 and of the RF single ended signal 62 generate electric field lines E that induce magnetic loops within the first primary winding 34, the first secondary winding 36, and the second secondary winding 38. In this embodiment, the first balanced transmission line 74 and the second balanced transmission line 76 are in a Transverse Electric and Magnetic (TEM) mode. The TEM mode refers to an arrangement of the balanced transmission lines 74, 76. In this arrangement, the electric field lines E and magnetic field lines M are both substantially parallel at a boundary plane of the conductors but are transverse to a direction D of signal propagation. Since the current of the positive side 50A of the RF differential signal 50 and the current of the RF single ended signal 62 are approximately equal in magnitude and opposite in phase, the magnetic field lines M essentially cancel outside the first secondary winding 36. Similarly, since the negative side 50B of the RF differential signal 50 is approximately equal in magnitude and opposite in phase to the RF single ended signal 62 in the second balanced transmission line 76, the magnetic field lines M essentially cancel outside of the second secondary winding 38. Furthermore, since the surface 78 and the surface 82 face one another in the first balanced transmission line 74, the electric field lines E are generally contained between the surfaces 78 and 82 so that the electric field lines E essentially cancel outside of the first secondary winding 36. Additionally, in the second balanced transmission line 76, the surfaces 80 and 84 face one another so that the electric field lines E are contained between the surfaces 80 and 84. In this manner, the electric field lines E in the second balanced transmission line 76 essentially cancel outside of the second secondary winding 38. As a result, electromagnetic leakage is significantly reduced thereby allowing the RF transmission line transformer 28 to operate in RF frequency bands. It should be noted that in alternative embodiments, the first balanced transmission line 74 and the second balanced transmission line 76 may be in a transverse electric (TE) mode or in a transverse magnetic (TM) mode. However, the TEM mode is advantageous since both the magnetic and electric field lines M, E are essentially cancelled outside of the RF transmission line transformer 28 to reduce electromagnetic leakage.

The laminate core 70 (shown in FIG. 2) may be made from various laminated substrate layers 86 as shown in FIG. 4. In this case, the characteristic impedance of the primary transformer coil 30 and the secondary transformer coil 32 is partially determined by the dielectric constant of the laminate material in the laminated substrate layers 86 and a thickness of the laminated substrate layers 86. Other factors contributing to the characteristic impedance are the horizontal and vertical thicknesses of the first primary winding 34, the first secondary winding 36, and the second secondary winding 38 along with the surface material utilized in the windings. The primary transformer coil 30 and the secondary transformer coil 32 may be made from a metallic material such as copper (Cu), gold (Au), silver (Ag), or nickel (Ni). The metallic material may also include metallic alloys and other metallic materials mixed with or forming ionic or covalent bonds with other non-metallic materials to provide a desired material property. For example, magnetic materials such as powdered iron or ferrite may be mixed with the metallic materials. Also, it should be noted that since the second secondary winding 38 is coupled to ground, the shunt capacitances between the surface 78 and the surface 82 and between the surface 84 and the surface 80 are reduced, thereby, increasing the performance of the RF transmission line transformer 28.

FIG. 5 illustrates one embodiment of a laminated substrate 88, such as a PCB. The laminated substrate 88 includes a laminated substrate body 90 formed from a laminate material. In this example, the RF transmission line transformer 28 is integrated with the laminated substrate body 90 and a part of the laminated substrate body 90 provides the laminate core 70. In FIG. 5, the first secondary winding 36 and the first and second terminals 40, 42 are shown on the top surface 72 of the laminated substrate 88. The remainder of the RF transmission line transformer 28 is provided within the laminated substrate body 90. An RF power amplifier 92 is also mounted on the laminated substrate body 90. The RF power amplifier 92 is connected to the first terminal 40 and the second terminal 42 to input or output the RF differential signal 50. Similarly, an antenna switch 94 is mounted on the laminated substrate body 90 and is coupled to the third terminal 60 of the first secondary winding 36 so as to receive or output the RF single ended signal 62. Since the RF power amplifier 92 is coupled to the first terminal 40 and the second terminal 42 of the primary transformer coil 30, this presents a power amplifier impedance of the RF power amplifier 92 at the first terminal 40 and the second terminal 42. Similarly, the antenna switch 94 is coupled to the third terminal 60. This presents an antenna switch impedance of the antenna switch 94 at the third terminal 60.

Due to the mutual inductance of the primary transformer coil 30 and the secondary transformer coil 32, an impedance transformation is provided by the RF transmission line transformer 28. The impedance transformation is such that a transformed impedance at the primary transformer coil 30 of the antenna switch impedance substantially matches the power amplifier impedance at the primary transformer coil 30. On the other hand, the primary transformer coil 30 and the secondary transformer coil 32 provide an impedance transformation such that a transformed impedance at the secondary transformer coil 32 of the power amplifier impedance substantially matches the antenna switch impedance at the secondary transformer coil 32. In one embodiment, the primary impedance of the primary transformer coil 30 is presented at 12 ohms while the secondary impedance of the secondary transformer coil 32 is presented at 40 ohms. This results in a TPE greater than 90%. To present 12 ohms at the primary transformer coil 30, the inductance of the primary transformer coil 30 should be set at 2 nH. On the other hand, to present 50 ohms at the secondary transformer coil 32, the inductance of the secondary transformer coil 32 should be set at 0.5 around 9 nH.

FIG. 6 illustrates a cross sectional view of the RF transmission line transformer 28 integrated with the laminated substrate body 90. The laminated substrate 88 may include a metallic structure integrated into the laminated substrate body 90 in order to provide connections to and from the electronic components. The laminated substrate body 90 is made from various laminated substrate layers 86, which is the case form the laminated substrate layers 86 of the laminate core 70 (shown in FIG. 5). The primary transformer coil 30 and the secondary transformer coil 32 form part of a metallic structure within the laminated substrate body 90 of the laminated substrate 88. In particular, the metallic structure has a first metallic layer 100, a second metallic layer 102, a third metallic layer 104, and the ground plate 65. The first secondary winding 36 is formed from the first metallic layer 100 and on the top surface 72 of the first laminated substrate layer 86. The first secondary winding 36 of the primary transformer coil 30 is formed by the second metallic layer 102 of the metallic structure. To receive the RF differential signal 50 (shown in FIG. 2), via 108 are provided to couple to the first terminal 40 and the second terminal 42 (shown in FIG. 2). Also, the conductive via 67 is formed through the laminate substrate layers 86 to couple the first secondary winding 36 and second secondary winding 38 of the secondary transformer coil 32. The ground plate 65 is attached at a bottom of the laminated substrate 88 to provide a ground node for the components mounted on the laminated substrate body 90, including the RF transmission line transformer 28. The conductive via 66 connects between the second secondary winding 38 and the ground plate 65 to provide the second secondary winding 38 with a ground node. Since the arrangement tends to cancel field lines, asymmetric variations in the thickness of the laminated substrate layers offset each other to minimize power performance impacts. Symmetric variations in the thickness of the laminate also have a smaller input on TPE. As such, variations in the thickness of the laminate have are less correlated FIG. 7 illustrates another embodiment of a RF transmission line transformer 110. The RF transmission line transformer 110 has a primary transformer coil 112 that forms a first primary winding 114 and a second primary winding 116. The secondary transformer coil 118 includes a first secondary winding 120, a second secondary winding 122, and a third secondary winding 124. As the windings 114, 116, and 120, 122, and 124 are substantially coaxial around a common axis 126 and are also symmetrical around the common axis 126, the transmissions lines formed by the RF transmission line transformer 110 are in the TEM mode. The first primary winding 114 of the primary transformer coil 112 is disposed between the first secondary winding 120 and the second secondary winding 122 such that the first primary winding 114 provides a first balanced transmission line with the first secondary winding 120 and the first primary winding 114 provides a second balanced transmission line with the second secondary winding 122. The second primary winding 116 of the primary transformer coil 112 is disposed adjacent to the second secondary winding 122 of the secondary transformer coil 118 such that the second primary winding 116 and the second secondary winding 122 form a third balanced transmission line. Furthermore, note that the second primary winding 116 is also adjacent to the third secondary winding 124. As a result, the second primary winding 116 is disposed between the second secondary winding 122 and the third secondary winding 124 so that the second primary winding 116 and the second secondary winding 122 provide a third balanced transmission line. Finally, the second primary winding 116 and the third secondary winding 124 provide a fourth balanced transmission line. Any number of primary and secondary windings may be provided in accordance with this arrangement.

Those skilled in the art will recognize improvements and modifications to the preferred embodiments of the present disclosure. All such improvements and modifications are considered within the scope of the concepts disclosed herein and the claims that follow.

What is claimed is:

1. A radio frequency (RF) transmission line transformer, comprising:

a primary transformer coil that forms a first primary winding;

a secondary transformer coil that forms a first secondary winding and a second secondary winding, wherein:

the first primary winding of the primary transformer coil is disposed between the first secondary winding and the second secondary winding of the secondary transformer coil;

the first primary winding, the first secondary winding, and the second secondary winding are substantially coaxially aligned along a common axis;

the first primary winding and the first secondary winding have substantially a same symmetry around the common axis and are configured to provide a first balanced transmission line, wherein common mode currents between the first primary winding and the first secondary winding are substantially cancelled, such that current on the first primary winding and current on the first secondary winding are approximately equal in magnitude and approximately opposite in phase; and the first primary winding and the second secondary winding have substantially a same symmetry around the common axis and are configured to provide a second balanced transmission line, wherein common mode currents between the first primary winding and the second secondary winding are substantially cancelled, such that the current on the first primary winding and the current on the second secondary winding are approximately equal in magnitude and approximately opposite in phase.

2. The RF transmission line transformer of claim 1, further comprising a laminate core made from a laminate material.

3. The RF transmission line transformer of claim 2 wherein the laminate core is part of a laminated substrate body of a laminated substrate.

4. The RF transmission line transformer of claim 3 wherein the primary transformer coil and the secondary transformer coil form part of a metallic structure within the laminated substrate body of the laminated substrate.

5. The RF transmission line transformer of claim 1 wherein the first balanced transmission line and the second balanced transmission line are in a Transverse Electric and Magnetic (TEM) mode.

6. The RF transmission line transformer of claim 1 wherein:

the first primary winding has a first winding end and a second winding end; and the primary transformer coil further comprises a first terminal that directly connects to the first winding end and a second terminal that directly connects to the second winding end so that a RF differential signal can be input or output from the first terminal and the second terminal.

7. The RF transmission line transformer of claim 6 wherein:

the first secondary winding has a third winding end and a fourth winding end;

the second secondary winding has a fifth winding end and a sixth winding end; and the secondary transformer coil further comprises a third terminal and a grounding element, wherein the third terminal directly connects to the third winding end of the first secondary winding, the fourth winding end of the first secondary winding directly connects to the fifth winding end of the second secondary winding, and the grounding element directly connects to the sixth winding end of the second secondary winding, so that a RF single-ended signal can be input or output from the third terminal.

8. The RF transmission line transformer of claim 1, wherein:

the first secondary winding has a first winding end and a second winding end;

the second secondary winding has a third winding end and a fourth winding end; and the secondary transformer coil further comprises a third terminal and a grounding element, wherein the third terminal directly connects to the first winding end of the first secondary winding, the second winding end of the first secondary winding directly connects to the third winding end of the second secondary winding, and the grounding element directly connects to the fourth winding end of the second secondary winding so that a RF single-ended signal can be input or output from the third terminal.

9. The RF transmission line transformer of claim 1, wherein:

the primary transformer coil further forms a second primary winding;

the secondary transformer coil further forms a third secondary winding; and wherein the second primary winding of the primary transformer coil is disposed between the second secondary winding and the third secondary winding of the secondary transformer coil such that the second primary winding and the second secondary winding provide a third balanced transmission line, and the second primary winding and the third secondary winding provide a fourth balanced transmission line.

10. The RF transmission line transformer of claim 1, wherein the primary transformer coil further forms a second primary winding, wherein the second primary winding of the primary transformer coil is adjacent to the second secondary winding of the secondary transformer coil such that the second primary winding and the second secondary winding form a third balanced transmission line.

11. A laminated substrate, comprising:

a laminated substrate body;

an RF transmission line transformer integrated with the laminated substrate body, wherein the RF transmission line transformer comprises:

a primary transformer coil that forms a first primary winding; and a secondary transformer coil that forms a first secondary winding and a second secondary winding wherein:

the first primary winding of the primary transformer coil is disposed between the first secondary winding and the second secondary winding of the secondary transformer coil;

the first primary winding, the first secondary winding, and the second secondary winding are substantially coaxially aligned along a common axis;

the first primary winding and the first secondary winding have substantially a same symmetry around the common axis and are configured to provide a first balanced transmission line, wherein common mode currents between the first primary winding and the first secondary winding are substantially cancelled, such that current on the first primary winding and current on the first secondary winding are approximately equal in magnitude and approximately opposite in phase;

the first primary winding and the second secondary winding have substantially a same symmetry around the common axis and are configured to provide a second balanced transmission line, wherein common mode currents between the first primary winding and the second secondary winding are substantially cancelled, such that the current on the first primary winding and the current on the second secondary winding are approximately equal in magnitude and approximately opposite in phase.

12. The laminated substrate of claim 11 wherein the RF transmission line transformer is integrated with the laminated substrate body such that a part of the laminated substrate body forms a laminate core of the RF transmission line transformer.

13. The laminated substrate of claim 11, further comprising:

an RF power amplifier mounted on the laminated substrate body and coupled to the primary transformer coil so as to present a power amplifier impedance at the primary transformer coil; and an antenna switch mounted on the laminated substrate body and coupled to the secondary transformer coil so as to present an antenna switch impedance at the secondary transformer coil.

14. The laminated substrate of claim 13 wherein the primary transformer coil and the secondary transformer coil provide an impedance transformation such that a transformed impedance at the primary transformer coil of the antenna switch impedance substantially matches the power amplifier impedance at the primary transformer coil.

15. The laminated substrate of claim 13 wherein the primary transformer coil and the secondary transformer coil provide an impedance transformation such that a transformed impedance at the secondary transformer coil of the power amplifier impedance substantially matches the antenna switch impedance at the secondary transformer coil.

16. The laminated substrate of claim 11, further comprising:

a metallic structure integrated into the laminated substrate body wherein the metallic structure comprises a first metallic layer, a second metallic layer, a third metallic layer, wherein the second metallic layer is disposed between the first metallic layer and the third metallic layer within the laminated substrate body;

the first primary winding of the primary transformer coil is formed by the second metallic layer;

the first secondary winding of the secondary transformer coil is formed by the first metallic layer;

the second secondary winding of the secondary transformer coil is formed by the second metallic layer; and the secondary transformer coil comprises at least one conductive via that directly connects the first secondary winding formed by the first metallic layer to the second secondary winding formed by the third metallic layer.

* * * * *